US006523704B2

(12) United States Patent
Sanders

(10) Patent No.: US 6,523,704 B2
(45) Date of Patent: Feb. 25, 2003

(54) TOOL STORAGE APPARATUS AND METHOD

(76) Inventor: Robert W. Sanders, 1804 SE. Lafayette St., Stuart, FL (US) 34997

( * ) Notice: Subject to any disclaimer, the term of this patent is extended or adjusted under 35 U.S.C. 154(b) by 0 days.

(21) Appl. No.: 09/879,638

(22) Filed: Jun. 12, 2001

(65) Prior Publication Data

US 2002/0074300 A1 Jun. 20, 2002

Related U.S. Application Data

(63) Continuation-in-part of application No. 29/118,653, filed on Feb. 14, 2000, now Pat. No. Des. 446,672.

(51) Int. Cl.[7] ..... A47F 5/00
(52) U.S. Cl. ..... 211/70.6; 211/87.1; 211/60.1
(58) Field of Search ..... 211/59.1, 87.1, 211/105.1, 60.1, 70.6, 69.5; 248/512, 538

(56) References Cited

U.S. PATENT DOCUMENTS 3,792,822 A * 2/1974 Underhill ..... 211/59.1 X
4,878,586 A * 11/1989 Bancroft et al. ..... 211/87.1
5,020,759 A * 6/1991 Weber ..... 211/87.1
5,145,135 A * 9/1992 Thompson ..... 211/60.1
5,232,103 A * 8/1993 Koenig et al. ..... 211/87.1
5,499,724 A * 3/1996 Hickman ..... 211/70.6
D372,092 S * 7/1996 Brown ..... 211/60.1 X
5,743,415 A * 4/1998 Smart ..... 211/70.6
5,765,699 A 6/1998 Griffin
5,833,079 A * 11/1998 Roberts ..... 211/85.7

* cited by examiner

*Primary Examiner*—Robert W. Gibson, Jr.
(74) *Attorney, Agent, or Firm*—Brinks Hofer Gilson & Lione

(57) ABSTRACT

A tool storage apparatus and method of manufacture thereof is provided. Tubular extensions allow storage of tools designed for connection with tubes or cylindrical members. Tubular extensions are connected at an acute angle to a base. The positioning of the tubular extension can minimize the space required for storage. For use with swimming pool maintenance tools, space efficiency can be maximized.

22 Claims, 2 Drawing Sheets

TOOL STORAGE APPARATUS AND METHOD

RELATED APPLICATIONS

This application is a continuation-in-part of application Ser. No. 29/118,653, filed Feb. 14, 2000, (now U.S. Pat. No. Des. 446,672), which is hereby incorporated by reference herein.

BACKGROUND

This invention relates to an apparatus for tools and equipment. In particular, the swimming pool maintenance equipment is stored on the apparatus.

Swimming pool equipment includes different types of brushes, vacuum cleaner heads and nets or skimmers. Typically, swimming pool maintenance equipment interchangeably connects with a pole. One pole is used with any of the brushes, skimmers or vacuum head. For vacuuming, a hose is used to connect the vacuuming head to a vacuum source.

The swimming pool maintenance equipment is stored on the ground, on shelves, or other locations convenient for use with the pool. Hooks for holding the equipment can be mounted on fencing or other structures near a pool. Special holders adapted for holding a hose have been used to store the vacuum hose.

U.S. Pat. No. 5,765,699 discloses an apparatus for holding and storing swimming pool maintenance equipment. The apparatus includes a support bar with brackets. The brackets comprise looped brackets and U-shaped brackets for holding the pole, vacuum hose, or other swimming pool maintenance equipment. However, the apparatus uses a large vertical space for holding all the various swimming pool maintenance equipment. Such space may not be available and is not esthetically pleasing. Also, looped brackets allow the equipment to hang loosely, which may also be not esthetically pleasing or efficient.

BRIEF SUMMARY

The present invention is defined by the following claims and nothing in this section should be taken as a limitation on those claims. By way of introduction, the preferred embodiment described below includes an apparatus for conveniently organizing tools and a method of manufacture thereof.

Tubular extensions allow storage of tools designed for connection with tubes or cylindrical members. Tubular extensions are connected at an acute angle to a base. The positioning of the tubular extension can minimize the space required for storage. For use with swimming pool maintenance tools, space efficiency can be maximized.

In one aspect, a tool storage apparatus for conveniently organizing tools is provided. A base is adapted for mounting to a substantially vertical surface. At least one tubular extension connects with the base at an acute angle.

In a second aspect, a pool tool storage apparatus for organizing swimming pool maintenance equipment is provided. A plurality of tubular extensions extend from a base. The plurality of tubular extensions each have an aperture at an end of the tubular extension. The aperture is adapted to hold swimming pool maintenance equipment.

In a third aspect, a method of manufacturing a tool storage apparatus is provided. A base is adapted for mounting to a substantially vertical surface. At least one tubular extension from the base is provided. The tubular extension connects at an acute angle to the base.

Further aspects and advantages of the invention are discussed below in conjunction with the preferred embodiments.

DETAILED DESCRIPTION OF THE PREFERRED EMBODIMENTS

A storage apparatus is provided for swimming pool maintenance equipment. Swimming pool maintenance equipment is designed for connection with a pole. The tool storage apparatus provides tubular extensions of a same shape as the pole. The swimming pool maintenance equipment is held by the tubular extensions for convenient storage. Further adaptations are provided for storing vacuum hose. Other tools designed for mating with a pole or tube can be stored on the apparatus.

Figure 1:
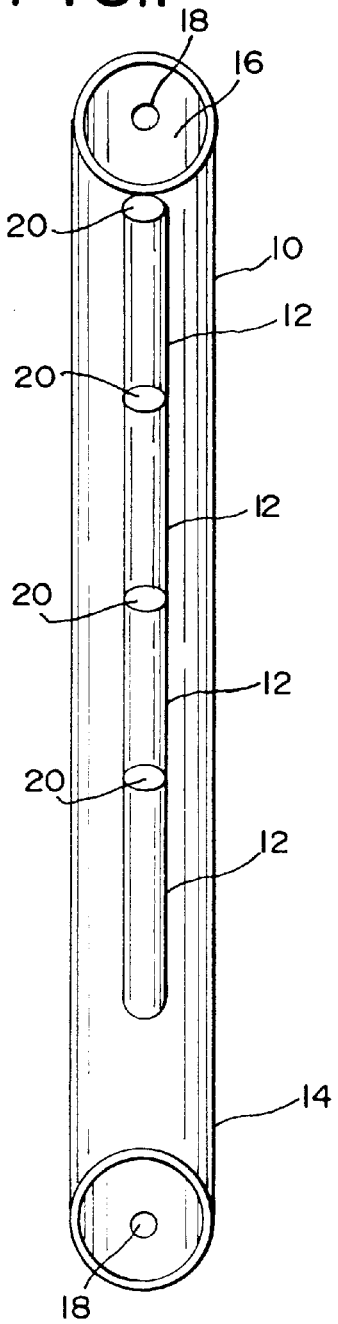
FIG. 1 is a front view of one embodiment of a tool storage apparatus.
Figure 2:
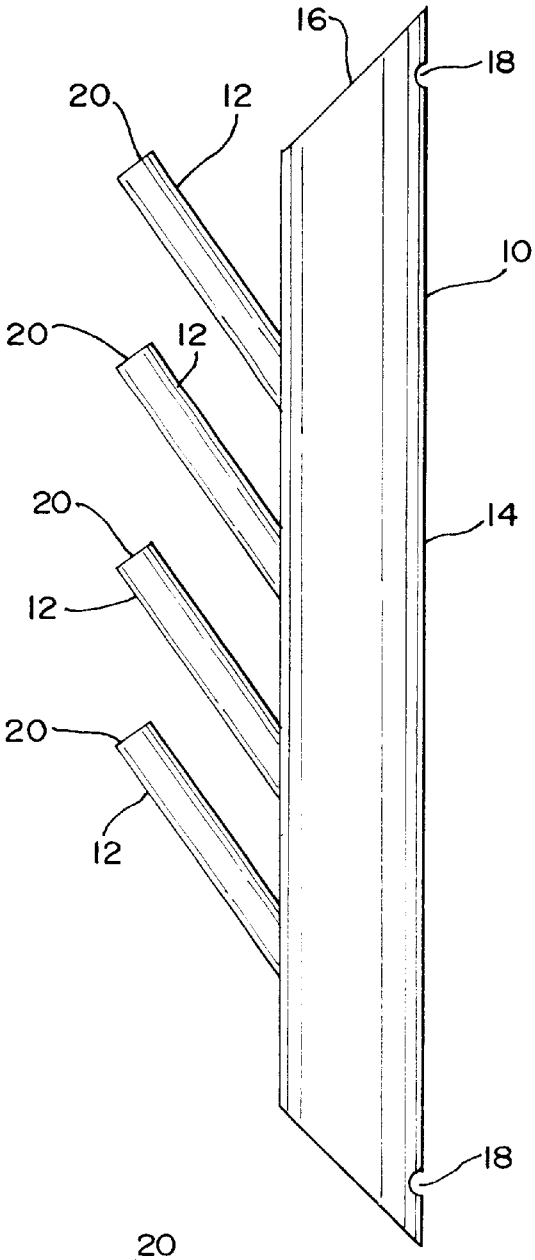
FIG. 2 is a side view of the tool storage apparatus of FIG. 1.
Figure 3:
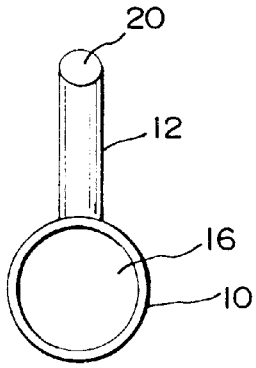
FIG. 3 is a top view of the tool storage apparatus of FIG. 1.

FIGS. 1–3 show a tool storage apparatus 10. The tool storage apparatus 10 includes a base 14 and a plurality of tubular extensions 12. Additional components may be used.

The base 14 comprises PVC, other plastic, metal, wood or other material. For example, the base 14 comprises a PVC tube of any dimension, such as 1½ inner diameter PVC. The PVC tube comprises an elongated element. An aperture 16 may extend throughout the base 14 or just into an upper portion or lower portion of the base 14 for holding a tool. The tubular PVC has a circular cross section as shown in FIG. 3. As shown, the ends of the base 14 are cut at angles but horizontal or other angles can be provided. In an alternative embodiment, a tubular base 14 has a cross section of any shape, such as a semicircle with a flat section for mounting adjacent a wall or a rectangular tube. In yet other alternative embodiments, a solid base without the aperture 16 of any shape, such as rectangular, is used.

The base 14 is adapted to mount on a substantially vertical surface, such as a wall, fence, pole, board, or other surface. In one embodiment, the base 14 includes apertures 18 for inserting a screw, bolt, rivet or other attachment mechanism to hold the base 14 to the vertical surface. In alternative embodiments, hooks, clips, wire, rope, indentations or other mechanisms are provided for connecting the base 14 to a vertical surface. For example, clips are provided for mounting the base 14 to a chain link fence.

In one embodiment, the base 14 comprises a pole with a waited floor stand. The waited floor stand maintains the base 14 in a vertical position, and the tubular extensions 12 are provided along an upper portion or other portion of the base 14. In yet another alternative embodiment, the base 14 is mounted to a frame or other freestanding structure. For example, a wood frame with a substantially vertical surface is connected with the base 14. In yet other alternative embodiments, the base 14 is adapted to mount to substantially horizontal surfaces, such as a cross bar or the ground. For example, the base 14 comprises a weighted base designed to sit on the ground.

The tubular extensions 12 comprise PVC, other plastic, metal, wood or other material. The tubular extensions 12 are formed at least in part as tubes. An aperture 20 is provided at one end away from the base portion 14. The aperture 20 is adapted to hold tools. For example, the tubular extension 12, and/or the aperture 20 are sized the same or similar as a pole used for swimming pool maintenance tools. In this embodiment, 1¼ inch inner diameter tubular extensions 12 are provided and sized to hold a brush, vacuum head, skimmer, and/or any other swimming pool maintenance tool. Swimming pool maintenance tools have tubular elements or extensions that fit within the aperture 20 or over the tubular extensions 12. The tubular extensions 12 have circular, rectangular, or cross sections of other shapes. Where all of these tools are designed for connection to a same sized pole, the tubular extensions 12 have a similar or same size. In alternative embodiments, the tubular extensions 12 comprise solid cylinders. As used herein, tubular extensions include hollow or solid extensions formed to mate with a tube or formed as a tube, in part or whole.

The tubular extensions 12 connect at an acute angle to the base 14 as shown in FIG. 2. When the base 14 is adapted to hang in a vertical position with respect to the elongated shape of the base 14, the tubular extensions 12 are angled upwards. Other angular connections may be used as a function of the intended position of the base 14. For example, a perpendicular angle of the tubular extension 12 to the base 14 can be used where the base 14 is adapted for resting on the ground. While all the tubular extensions in FIG. 2 are shown at a same angle, different angles for different tubular extensions 12 relative to the base 14 may be used.

As shown, four tubular extensions 12 are provided. In alternative embodiments, at least one, a plurality, three or other numbers of tubular extensions 12 are provided. The tubular extensions 12 have a same size and shape, but different lengths, cross-sectional shapes or other characteristics may vary from one tubular extension 12 to another. The tubular extensions 12 are equally spaced along the base 14, such as spacing associated with the types of tools to be stored. In one embodiment, about 4 inches separates each tubular extension 12. In alternative embodiments, different spacing or spacing that varies between pairs of tubular extensions 12 is used. As shown in FIGS. 1 and 3, the tubular extensions 12 are aligned linearly along the base portion 14. In other embodiments, the tubular extensions 12 are angled in different directions from the base 14. For example, pairs of tubular extensions 12 extend at 90° from each other from the base 14 at the same or different horizontal positions along the base 14.

Figure 4:
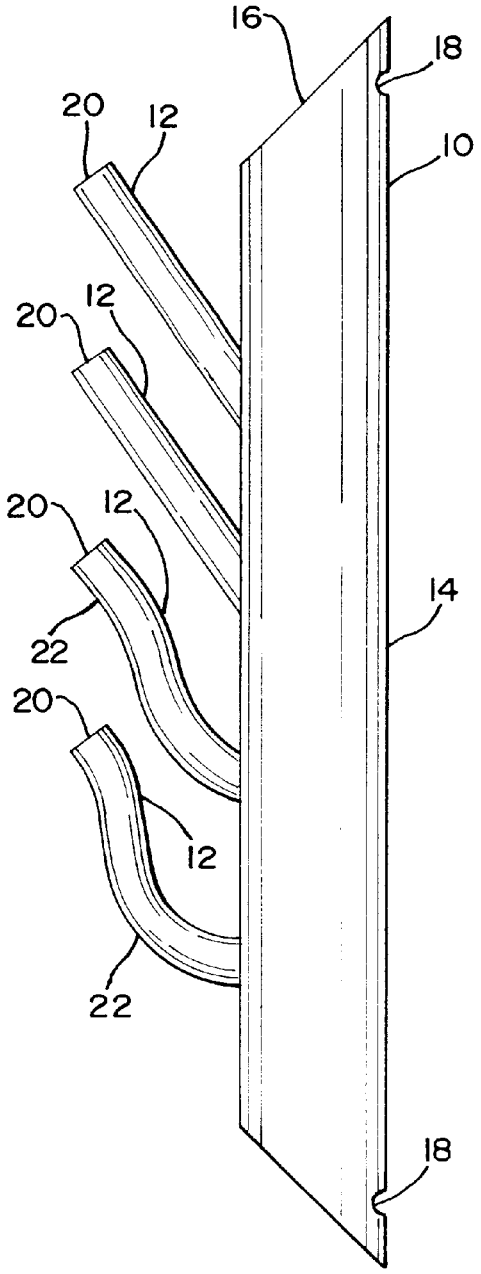
FIG. 4 is a side view of one embodiment of a tool storage apparatus for holding a hose.

FIG. 4 illustrates the tool storage apparatus 10 with different tubular extensions 12. Two curved tubular extensions 22 are provided. The curved tubular extensions 22 are curved to more conveniently hold vacuum hose. For example, the curved tubular extensions 22 have an upward hook shape, an undulating curved shape, or other curves for holding hose. In one embodiment, at least the lower most tubular extension 12 comprises a curved tubular extension 22. In alternative embodiments, a non-lowermost tubular extension 12 is curved. None, one, more than one, or all of the tubular extensions 12 may be curved.

Figure 5:
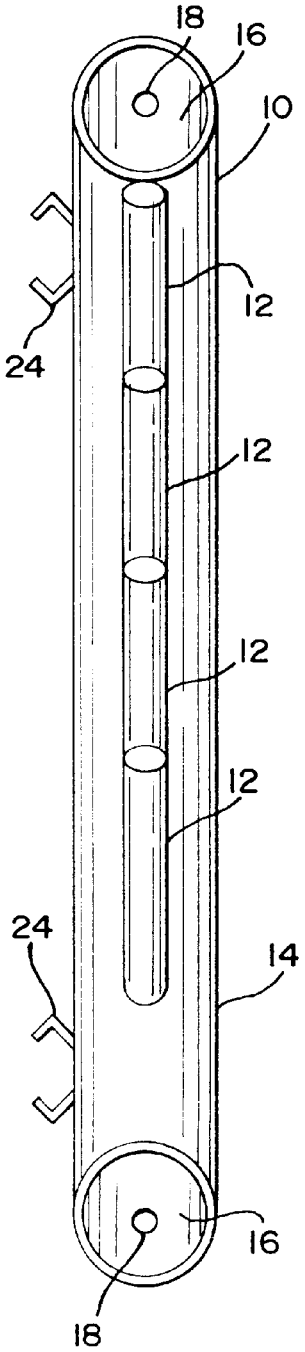
FIGS. 5 and 6 are front and back views of one embodiment of a tool storage apparatus with a clip.
Figure 6:
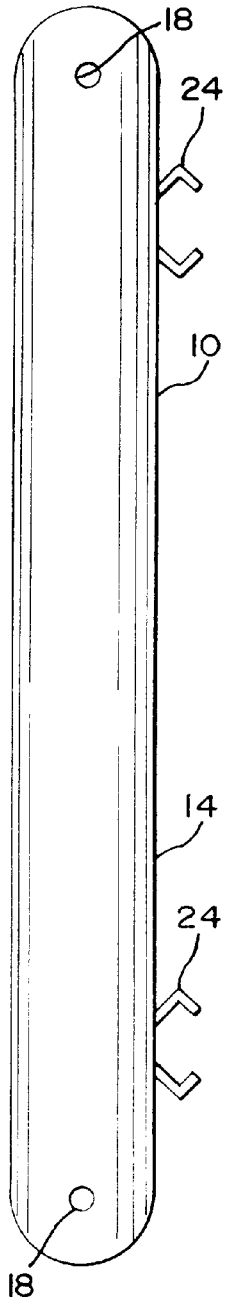

FIGS. 5 and 6 show a front and back view, respectively, of the tool storage apparatus 10 with clips 24. The clips 24 comprise metal, plastic, or other material. For example, the clips 24 comprise spring tensioned metal brackets or metal brackets formed of a semi-circular spring metal. The clips 24 are sized in one embodiment to hold a swimming pool maintenance tool pole, such as a 1¼ inch or 1½ inch hollow metal tube. The clips 24 hold the pole by spring tension or other tension. In alternative embodiments, the clips 24 comprise belts or latches for tying or latchably connecting the pole to the base 14.

In one embodiment, two clips 24 near the ends of the base 14 are provided. The clips 24 are arranged or aligned so that the pole is connected substantially parallel to the elongated base 14. In alternative embodiments, a single clip 24 or three or more clips 24 are provided. The clips 24 are positioned to avoid interference with the tubular extensions 12 and allow the pole to attach to the base 14 without contact or with minimal contact with the vertical surface or wall. In alternative embodiments, clips 24 can be provided for holding multiple devices, or multiple clips 24 can be used to hold different devices.

The tool storage apparatus 10 is manufactured according to the material used. The base 14 is adapted for mounting to a substantially vertical surface. Apertures 18 are drilled or molded into the base 14. Alternatively, clips, hooks or indentations are attached or formed in the base 14. For PVC, the apertures 18 are drilled. For molded plastic, the apertures 18 are formed as part of the mold.

Tubular extensions 12 are provided by molding the tubular extensions 12 with the base 14. Alternatively, the tubular extensions 12 are glued, welded, clipped, latched or otherwise attached to the base 14. In one embodiment, holes are drilled in the base 14, and the tubular extensions 12 are inserted and glued in the holes. The tubular extensions 12 are provided in acute angle to the base 14 as a function of the direction of the holes drilled in the base 14 or the angle of a cut on the end of the tubular extensions 12 for attachment to the base 14.

The clip 24 is attached to the base 14. The clip 24 is screwed, riveted, glued, latched, formed or molded to the base 14. The clips 24 are attached to hold a pole or other object substantially parallel to the base 14. In alternative embodiments, the clips 24 are aligned to hold objects in non-parallel positions relative to the base 14.

In one embodiment, the tool storage apparatus 10 is used for conveniently storing vacuum cleaner extenders and other vacuum attachments. The vacuum attachments are placed over the tubular extension 12 or within the inner diameter of the aperture 20 on the tubular extension 12.

In alternative embodiments, an adaptor or tube is inserted within the aperture 20 of the tubular extension 12. The adaptor is sized to hold vacuum cleaner attachments or other attachments of different sizes. The adaptor comprises any cross-sectional shape and hollow or solid tube. In other embodiments, an adaptor is provided for swimming pool maintenance tools. Other types of tools can be stored on the tool apparatus 10.

While the invention has been described above, by reference to various embodiments, it will be understood that many changes and modifications can be made without departing from the scope of the invention. For example, freestanding base 14 with tubular extensions 12 extending in any of various directions can be used.

It is therefore intended that the foregoing detailed description be understood as an illustration of the presently preferred embodiments of the invention, and not as a definition of the invention. It is only the following claims, including all equivalents, that are intended to define the scope of this invention.

What is claimed is:

1. A tool storage apparatus for conveniently organizing tools, the apparatus comprising:

a base adapted for mounting to a substantially vertical surface, the base comprising a tubular structure with an aperture adapted for holding a tool; and at least one tubular extension from the base, the extension connected at an acute angle to the base.

2. The apparatus of claim 1 wherein the at least one tubular extension comprises a plurality of tubular extensions.

3. The apparatus of claim 2 wherein the plurality of tubular extensions comprises at least three tubular extensions.

4. The apparatus of claim 1 wherein the base comprises mounting apertures.

5. The apparatus of claim 1 wherein the base comprises mounting hooks.

6. The apparatus of claim 1 wherein the at least one tubular extension has an aperture at an end of the at least one tubular extension.

7. The apparatus of claim 1 wherein the aperture of the tubular base extends along an entire length of the tubular base.

8. The apparatus of claim 1 further comprising:

at least one curved extension.

9. A tool storage apparatus for conveniently organizing tools, the apparatus comprising:

a base adapted for mounting to a substantially vertical surface;

at least one tubular extension from the base, the extension connected at an acute angle to the base; and at least one clip in addition to any mounting device for holding the base, the at least one clip connected with the base, the at least one clip aligned to hold one of the tools substantially vertical to a ground.

10. A method of manufacturing a tool storage apparatus for conveniently organizing tools, the method comprising:

(a) adapting a base for mounting to a substantially vertical surface;

(b) providing at least one tubular extension from the base at an acute angle to the base;

(c) attaching at least one clip to the base, the at least one clip in addition to any device for mounting the base pursuant to (a);

(d) aligning the at least one clip to hold one of the tools substantially vertical to a ground.

11. The method of claim 10 wherein (b) comprises providing a plurality of tubular extensions.

12. The method of claim 10 wherein (a) comprises providing mounting apertures.

13. The method of claim 10 wherein (b) comprises providing the at least one tubular extension with an aperture at an end of the at least one tubular extension.

14. The method of claim 10 wherein (a) and (b) comprise molding the base and at least one tubular extension.

15. A pool tool storage apparatus for organizing swimming pool maintenance equipment, the apparatus comprising:

a base having a tubular element with an aperture at the top end of the base, the aperture adapted to hold swimming pool maintenance equipment; and a plurality of tubular extensions from the base, the plurality of tubular extensions each having an aperture at an end of the tubular extension;

wherein the aperture is adapted to hold swimming pool maintenance equipment.

16. The apparatus of claim 15 wherein the plurality of tubular extensions comprises at least three tubular extensions.

17. The apparatus of claim 15 wherein the base is adapted for mounting to a substantially vertical surface.

18. The apparatus of claim 15 wherein the base has top and bottom portions each at an acute angle to a length of the base, a front of the base being shorter along the length than a back of the base.

19. The apparatus of claim 15 further comprising:

at least one curved extension connected with the base.

20. The apparatus of claim 15 wherein the base comprises an elongated base; and further comprising:

at least one clip connected with the base, the at least one clip in addition to any device for holding the base and the at least one clip aligned to hold a swimming pool maintenance equipment tool substantially parallel to the base.

21. The apparatus of claim 15 wherein the plurality of tubular extensions comprise:

a first tubular extension having an aperture adapted to hold tubular portion of a pool brush; and a second tubular extension having an aperture adapted to hold a tubular portion of a pool vacuum head.

22. The apparatus of claim 21 wherein the apertures of the first and second tubular extensions are substantially the same size.

* * * * *